US005324077A

United States Patent [19]

Kessler et al.

[11] Patent Number: 5,324,077

[45] Date of Patent: Jun. 28, 1994

[54] MEDICAL DATA DRAFT FOR TRACKING AND EVALUATING MEDICAL TREATMENT

[76] Inventors: Woodrow B. Kessler, 765 Hillview Rd.; Rex K. Kessler, 761 Hillview Rd., both of Malvern, Pa. 19355

[21] Appl. No.: 975,984

[22] Filed: Nov. 13, 1992

Related U.S. Application Data

[63] Continuation of Ser. No. 623,359, Dec. 7, 1990, abandoned.

[51] Int. Cl.[5] ..... B42D 15/00

[52] U.S. Cl. ..... 283/54; 283/58; 283/900

[58] Field of Search ..... 283/67, 57, 58, 54, 283/900; 235/449, 493, 494; 382/7; 902/4

[56] References Cited

U.S. PATENT DOCUMENTS

| | | | |
|---|---|---|---|
| 1,587,242 | 6/1926 | Rumely | 283/58 |
| 2,536,371 | 1/1951 | Hutchison | 283/58 |
| 3,980,323 | 9/1976 | Boyreau | 283/58 |
| 4,630,844 | 12/1986 | Troy et al. | 283/67 |
| 4,641,239 | 2/1987 | Takesako | 902/4 |
| 4,733,060 | 3/1988 | Dono et al. | 902/4 |
| 4,916,611 | 4/1990 | Doyle, Jr. et al. | 364/401 |
| 4,948,174 | 8/1990 | Thomson et al. | 283/58 |

*Primary Examiner*—Mark Rosenbaum
*Assistant Examiner*—David P. Bryant
*Attorney, Agent, or Firm*—Robert S. Lipton

[57] ABSTRACT

The method and apparatus of this invention permit quality review by medical insurers of ambulatory patient care by gathering medical data on each and every ambulatory visit and by providing a unique data transmission system to timely and accurately report the data for analysis. Negotiable medical data drafts are provided to participating medical care providers, who are authorized to issue the draft to themselves and sign the draft at the conclusion of each patient's visit. In exchange for immediate partial payment for services rendered, the medical service provider is required to enter the requested medical data summarizinq the patient's visit on the data entry portions of the negotiable medical data draft. Deposit in its bank of the medical data draft by the medical care provider returns to the provider immediate cash and places the medical data in a transmission system designed and monitored for accurate and reliable handling. After making archival copies of the medical data draft, the medical data drafts are ultimately returned by the insurer's bank to the insurer. The medical data available on the medical data draft may be analyzed by the insurer for quality review purposes. Establishment of a comprehensive data base, based on the data available from medical data drafts, enables insurers and medical professionals to examine the level of health care across the population at a level of detail previously impossible. Implementation of the method and apparatus of this invention should permit significant cost savings for the health care insurance system.

9 Claims, 3 Drawing Sheets

MEDICAL DATA DRAFT FOR TRACKING AND EVALUATING MEDICAL TREATMENT

This is a continuation of co-pending application Ser. No. 07/623,359 filed on Dec. 7, 1990, now abandoned.

BACKGROUND OF THE INVENTION

This invention relates generally to the field of quality control review medical treatment and, more specifically, to a system for gathering and evaluating data on the delivery of medical care for ambulatory patient visits. In this application, the term "medical" is used in its broadest sense which encompasses the health related activities and knowledge of all health professionals including, but not limited to, doctors, dentists, other licensed health professionals, and those in the allied health professions.

A major economic problem that has risen during the past twenty years has been the upward spiraling cost of medical care. Demographic factors have played one role in this increased cost since extended life expectancies increase the percentage of older individuals in the population. Generally, such individuals require a much higher degree of medical care. A second major factor contributing to increased costs for medical care has been the advent of many new, expensive, medical procedures which have sprung from medical and instrumentation advances of the past ten years. More widely known examples are organ transplants and the use of CAT scanners or MRI units for routine diagnosis. An additional factor has been the increased rate of inflation, which has dramatically influenced the costs for drugs.

Due to all of the above, as well as other factors, the cost of even routine medical care has increased dramatically. Correspondingly, insurers of medical care have had to increase their charges dramatically in order to offset these much higher costs. The insurer of the largest group in the United States, the Health Care Financing Administration, which administers Medicare, has been particularly susceptible to the dramatic increases since Medicare provides coverage primarily to those individuals who have reached their sixty-fifth birthday. After a few years experience with the Medicare program, Medicare administrators became aware of the fact that many of the charges being submitted by medical care providers were excessive, if not outright fraudulent. This has led to a system of quality review of the professional performance of medical care providers participating in the Medicare program and has resulted in criminal prosecutions in addition to civil actions against offending professionals.

In order to better control the rising hospitalization costs for the elderly, a hospital admissions and treatment review program was instituted by Medicare to evaluate the appropriateness of the care given to Medicare recipients at hospitals. Concerns over quality of care have thus also become concerns that unnecessary medical treatment is being given to patients for which the insurer is being billed. Such unnecessary costs must be reflected in increased insurance premiums. This review program has been implemented in all states within the United States, and has resulted in significant savings for unnecessary hospitalizations, unnecessary treatments, and overly-long hospital stays. This Medicare review program has become a model program by which hospital admissions and procedures are also being evaluated nation-wide by private insurers. While the current standards for appropriate treatment of Medicare patients in hospitals are set by each state, there is evolving a national consensus towards what constitutes appropriate medical care. Not only are each state's standards available for review and discussion by the standard setting organizations of other states, but also private insurers are generally utilizing the same standards which the Medicare state review agencies have devised. It is probable that such national use will ultimately lead to a uniform set of standards across the United States for hospital admission and treatment of both Medicare recipients and privately insured individuals. Quality review of hospital admissions and treatment was chosen for initial review for two reasons: (1) hospitalizations represented a significant faction of the total dollars expended by the Medicare system; and (2) hospital procedures and record keeping made review of cases relatively straight forward and accessible.

Private insurers have followed the government's lead in attempting to reduce hospitalization costs by requiring their insureds to obtain prior approval from the insurer for non-emergency hospitalizations. Virtually all insurers in the United States have adopted a system whereby an insured is required to contact the insurance carrier prior to non-emergency hospital admission. The insurance carriers have developed screening procedures and minimum criteria, which they believe weed out unnecessary hospitalizations for their insureds. Whether the actions by the private insurers have been as effective as actions by Medicare is unclear since they lack the statutory enforcement authority provided Medicare. For instance, any doctor or hospital found in violation of the Medicare standards may, after an appropriate opportunity to correct their behavior, be expelled from the Medicare system. For both doctors and hospitals, expulsion means a major decrease in their patient base with loss of concomitant funding, which very few doctors or hospitals can afford. Thus, the Medicare restraints work directly on the doctors and the hospitals. On the other hand, private insurers must attempt to enforce quality review procedures and cost controls through the only persons with whom they have contracts, their insureds. Insurers hope that by refusing to pay for what they believe are unnecessary procedures and hospital admissions, which results in their insureds paying for a higher percentage of such costs, they will dissuade their insureds from utilizing those doctors and hospitals providing the unnecessary medical care. Neither the quality review procedures used by Medicare nor those used by private insurers addresses the issue of quality review of the medical services provided to ambulatory (office visit) patients. Since this represents the other major cost of medical care, it represents an area for potentially great savings to the insurance systems.

However, implementation of a nation-wide quality review system covering services rendered to ambulatory patients has not heretofore been attempted due to the overwhelming number of patients and patient visits involved. While there is a large number of admissions based upon hospital capacity, there are hundreds of times more doctors and other medical care providers than hospitals. Each doctor and medical care provider in turn may have several thousand patient office visits per year. Medicare has been directed to have in place by 1992, a quality review system for ambulatory care. At the present time, it is anticipated that such a system will be based upon a traditional "chart audit" in which patient charts will be randomly selected from medical care provider's offices for individual review by a quality review evaluation panel. Not only will there be problems with the statistics of such a review, but to date, no chart audit criteria had been developed or proposed by Medicare for implementation with such a system.

Any attempt at quality review of every ambulatory visit under the current system of insurance administration is impossible due to the paperwork overhead. In current reimbursement systems there is a multiple stage process which is required before a medical care provider is paid by the insurers for services rendered, whether the insurer is the government or a private entity. The multiple stage paperwork generating processing is a burden for the medical care providers, the insurer, and the patient. Typically, for instance, the patient is required to fill out part of a medical care form prior to submission of the form to the medical care provider. The medical care provider must then add its data to the form, and either the provider or the insured must then forward the form to the insurer. The insurer must review the material, verify coverage, and determine whether the charges should be paid. Only then does the insurer issue a draft to the medical care provider or the insured, as the circumstances of the insurance contract warrant. Under current practice, quality review by a private insurer is only possible at the end of a burdensome data gathering process. More often than not, it is necessary for the insurer to obtain additional information, either from the insured or from the medical care provider in aid of making a quality review determination. The multiple levels of paper work require the expenditure of significant time and effort by all parties involved which itself increases the cost of insurance as well as over-burdening the system at all levels with administrative overhead.

Private insurers have also not implemented, and have no immediate plans to implement, any type of quality review of ambulatory patient care. As mentioned above, the large number of patient visits, including repetitive visits by the same patient for the same problem, as well as the possibility that patients may seek care for any number of medical concerns during a typical year, make the likelihood of assessing the total adequacy and quality of care being rendered to ambulatory patients by a chart audit process nearly impossible. Indeed, a patient may see more than one medical care provider for the same medical problem, with or without notice to the providers. Thus, a review of a patient's chart from one provider's office may still not yield a clear picture of the quality of care being delivered to that patient.

While eliminating unnecessary treatment is the initial goal of such quality review procedures, it is quite clear that down the line one additional benefit will be the ability to ascertain that all patients are receiving the appropriate and complete medical care for which the insurance system is paying. However, for providers and patients already overwhelmed by a system of insurance forms and record keeping, a comprehensive ambulatory review system which imposes additional paperwork demands would not likely produce the desired information due to resistance by both the patients and the providers to dealing with yet another level of bureaucracy.

Ideally, any quality review procedure examining the care given ambulatory patients would track all patient visits to medical care providers.

SUMMARY OF THE INVENTION

Clearly, the major problem in establishing quality review of ambulatory patient care using currently available insurer procedures is the overwhelming paperwork associated with gathering the comprehensive data required by such a review system. The method and apparatus of this invention permit the recordation, transmittal, and analysis of the quality of service delivered to ambulatory patients by all participating medical care providers with n significant increase in paperwork requirements and, as a side benefit, provide an economic incentive to participating medical care providers to aid in the quality review analysis. According to the invention, negotiable medical data drafts are provided to participating medical care providers who are authorized to execute medical data drafts made out to themselves. For each patient who is covered by an insurance policy, the medical care provider is authorized to immediately issue to itself a medical data draft in an amount up to a set limit towards the cost of the patient's visit. At the time of issuing the medical data draft, the medical care provider is required to record medical data in an area of the draft designated for entries relevant to the medical service performed for the patient. The full costs of the ambulatory visit are also indicated on the medical data draft along with an identifier of the patient and the patient's insurance plan. Deposit of the medical data draft to the medical care provider's bank account immediately provides the medical care provider with payment for the services rendered. After processing by the payor's/insurer's financial institution, the medical data draft is returned to the insurer where medical information on the draft is recorded in a data base. The data base may be appropriately searched and information correlated according to established quality review standards. In addition, the information may be used to complete payment under the insured's medical plan to the medical care provider for any additional cost of the visit, which is covered by the insured's policy, beyond the amount of the medical data draft.

The method and apparatus of this invention successfully permits the acquisition and evaluation of ambulatory care services rendered on an out-patient basis by medical care providers in conjunction with any insurance program. The invention meets the objectives of evaluating the sufficiency and adequacy of the medical care provided so that excess and unnecessary care may be recognized and the cost for such care reduced. However, the method and apparatus of this invention accomplishes much more since it also permits evaluation of the adequacy of the care rendered to determine whether, in fact, a patient is receiving all the care that patient requires. Further, because of the comprehensive scope and nature of the data base generated, the method of the invention allows for recognition of unusual and potentially dangerous behavior by the patient in seeking simultaneous care from multiple sources.

The key to accomplishing these results lies in establishing a data base, which reflects accurately and in a timely manner, every ambulatory visit of a patient to a medical care provider and the care rendered to that patient on each occasion. The method and apparatus of this invention achieves these results.

Therefore, the first object of this invention is to provide a verifiable accurate record of every ambulatory patient visit to a medical care facility.

A second object of this invention is to get the medical care provider to immediately and accurately report the patient's visit including immediately and accurately reporting the exact nature of the services rendered to the patient.

Another object of this invention is to guarantee the successful and timely transmission of the data on patient care generated by the medical care provider to the insurer for quality review.

An additional object of this invention is to cause the creation and maintenance of an independent copy of all the gathered medical data which copy may be used to verify the authenticity of the data in the insurer's data base.

An additional object of this invention is to control and enforce accurate data transfer.

A further object of this invention is to provide a medical history of a patient across a number of years and number of doctors, so the patient has the benefit of a summary medical record when seeking treatment with a new physician.

A further additional object of this invention is to gather the large amount of data on each ambulatory patient visit in an efficient and cost effective manner.

A further object of this invention is to analyze the data for quality review and cost control purposes.

A further object of this invention is to protect the confidentiality of the patients at all stages of the evaluative system.

A further object of this invention is to inexpensively, and without additional cost, achieve the above results.

DETAILED DESCRIPTION OF THE INVENTION

As mentioned above, the data gathering and transmission problem associated with any attempt to reliably record and transmit data on each ambulatory patient visit at every medical care provider's office has two subcomponent problems. The first subcomponent part of the problem arises from the reluctance of medical care providers to comply with any additional record keeping and reporting requirements, especially in the midst of busy patient care. Without the full cooperation of the medical care providers accurately and promptly recording the relevant medical data for transmission, no reliable system can be developed. The problem may therefore be stated as: what type of system will guarantee the accurate reporting of the medical data, at little or no additional cost either in time or effort to the medical care provider? The second subcomponent part of the problem arises from the need to guarantee the transmission of the data to the insurer for processing and data analysis. This aspect may be further divided into considerations of timely transmission of the data and accurate and verifiable transmission of the data. Thus, even if the data on each ambulatory visit is reliably recorded in form for transmission by the medical care provider, there must be some mechanism to guarantee that the data is first, timely transmitted, and second, to guarantee that the data is transmitted and recorded reliably.

The principle feature of this invention is the provision of a method and apparatus for the solution of the above problems which is both simple and yet elegant. Using the method and apparatus of this invention, data is recorded reliably, accurately, and is transmitted on a timely basis for analysis and quality review of the care provided. Simultaneously, independent copies of all the data are created and maintained which are available to verify the authenticity of the data. As a side benefit, the payment and administrative functions normally inherent in an insurance contract are administered.

Figure 1:
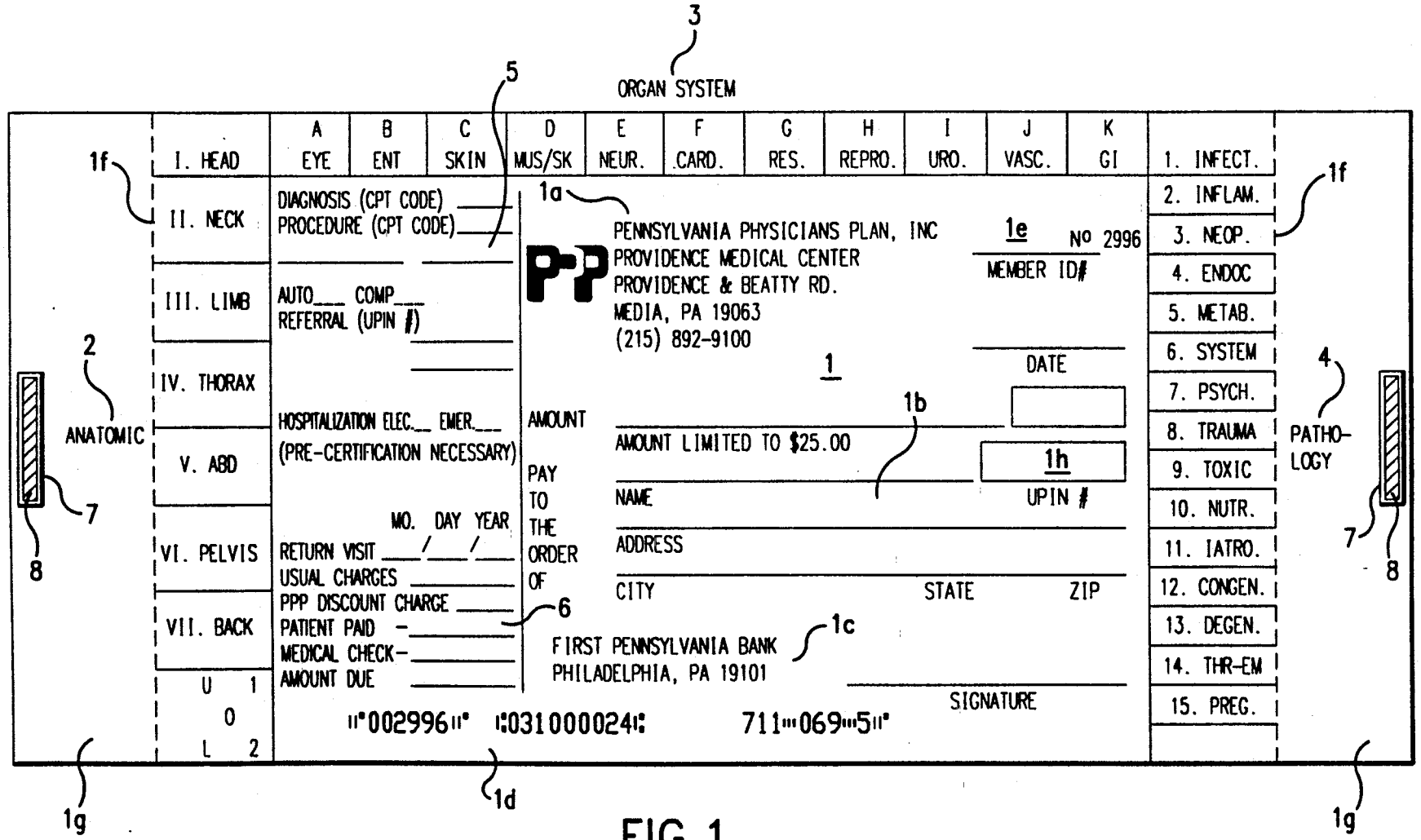
FIG. 1 shows a medical data draft having defined areas for the entry of patient medical data along with an area which provides the information necessary to make the medical data draft a negotiable instrument.

The basic apparatus of the invention consists of a specially designed check or monetary draft. As the principle instrument of data transmission, the invention uses a combination check/draft and medical diagnosis and treatment record. FIG. 1 shows a typical example of such a data transmission device, a medical data draft. The medical data draft has extension tabs 1*g* separated from the body of the draft by perforated scores 1*f*. In tabs 1*g* are located holes 7 which permit the draft to be located over alignment posts 8. The central area of the apparatus forms a standard negotiable draft which will be honored by any bank. Medical data draft section 1 includes a payor identifier area 1*a*, a payee identifier area 1*b*, a bank identifier area 1*c*, and scannable numerical banking data 1*d*. Area 1*h* is provided for the entry of the physician's identifying number assigned under the national registration system implemented this year. The check part of the medical data draft apparatus is thus usable to transfer funds in the normal course of banking business.

In addition to the part of the medical data draft which constitutes a negotiable instrument, the apparatus contains various medical data entry areas. In FIG. 1 the basic medical data to be transmitted by the device has been broken down into different anatomic regions 2, organ systems 3, and pathology 4. In addition, there is provided an area 5 in which can be entered specific diagnosis and procedure codes as well as additional information relating to hospitalization. In area 6, the cost and charge information for the patient visit may be recorded. By appropriately marking the medical data draft apparatus, a medical care provider can quickly provide a comprehensive summary of the areas of the patient's body which have been treated during a given visit, as well as pertinent diagnostic information. Obviously, various arrangements of this data, as well as additional information, may be used in order to provide different levels of medical data reporting. After marking the medical data draft, the medical care provider may remove tabs 1*g* by tearing along perforated scores 1*f*. The significant advance represented by this invention is made possible by the integration into a medical care quality review system of the combination of patient medical data with a negotiable instrument for use with the established funds transfer system. The combination of the patient medical data record and payment draft enables collection of data for quality review at every patient visit and provides a unique mechanism for the prompt and accurate transmission of medical data through the banking system.

In use, according to the method and apparatus of this invention, patient medical data drafts are distributed to medical care providers who have agreed with the insurer to participate in a quality review system. Such medical care providers are authorized to make the medical data draft payable to themselves and to sign the draft. Thus, when a patient, who is covered by an insurer utilizing the method and apparatus of this invention, requests medical care, the patient displays the patient's identification card to the medical care provider. The patient's medical identification card indicates to the medical care provider that the patient is covered by an insurer's medical data draft system and provides the patient's identification number with that insurer. This data is entered on the medical data draft of FIG. 1 in area 1*e*.

After the patient has received care by the medical care provider, the medical care provider is authorized to issue to itself a medical data draft for the provider's services and to sign the medical data draft. The medical data draft is drawn upon an account maintained by the insurer. Thus, the medical care provider receives instant payment (a negotiable draft) from the insurer for the services which the provider has just rendered to the patient. Generally the medical data draft covers a significant portion, if not all, of the cost of the care just rendered. To the extent that the cost of the care does not exceed the payment limit of the medical data draft, the medical care provider writes the medical data draft for the actual cost. To the extent that the cost of the care exceeds the payment limit of the medical data draft, the medical care provider indicates the charges and the amount owed on the medical data draft.

The medical data draft of this invention also functions, in lieu of any other insurance submission form, as a request by the medical care provider for supplementary payment for services. The patient's insurance card may also indicate whether any deductibles apply to the patient's insurance policy and whether such deductibles have been met. The medical care provider subtracts from the amount to be paid by the medical data draft any amount paid by the patient to satisfy the deductible. There are, in addition, further immediate side benefits to the medical care provider. First, the medical care provider does not need to wait for reimbursement by the insurance company, thereby, diminishing cash flow problems to the provider. Second, the medical care provider normally does not need to process, keep track of, or retain any additional insurance related paperwork.

In exchange for immediate payment for its services, the medical care provider agrees to complete the patient medical data information sections of the medical data draft apparatus. As noted, the medical data entered in this device replaces the insurance forms which the medical care provider would otherwise have to fill out for each patient visit. In this manner, the medical care provider not only receives immediate payment for its services, but, by completing the data entry sections of the medical data draft is released from any further obligation for time-consuming, complex, or burdensome paperwork in completing additional insurance forms. The medical data draft is the only insurance form required to be filled out by the medical care provider. There is, therefore, immediate and strong incentive for the medical care provider to complete the data entry portion of the medical data draft device. If it is desired, a carbon of the medical data draft minus the draft provisions may be retained by the medical care provider for its records. The unique apparatus of this invention makes the timely and accurate entry and transmission of medical data achievable with all medical care providers for each and every patient visit.

Deposit in a bank of the medical data draft by the medical care provider returns to the provider immediate cash and places the medical data in a transmission system designed and monitored for accurate and reliable handling. The medical data encoded on the medical data draft is transparent to the check handling system as long as the integrity of the negotiable draft data is maintained. By using a medical data draft to gather the fundamental medical care service information, the invention also automatically creates an independently maintained and accessible copy of the patient medical data. The method and apparatus of this invention accomplishes this by taking advantage of the fact that the banking system maintains microfilm records of all negotiable draft transactions. The banking system, having no interest in the medical data, per se, on each medical data draft, provides an impartial, unbiased, and responsible custodian of the data. For instance, using the method and apparatus of this invention, in medical malpractice actions the patient, the medical care provider, and the insurer now have the ability to verify treatment information from a record source none of them maintains. This feature of the invention, itself, may lower the cost of medical care (by lowering medical care providers' insurance premiums) by reducing uncertainty in such legal actions by providing unbiased independent data storage. Thus, the system of this invention uses an available data transmission and storage system already in place which adds no incremental cost for transmitting the medical data from a medical care provider to an insurer. Once processed by the bank, the medical data draft is returned to the insurer. This process normally takes only a few days in the American banking system even for cross-country clearance. Therefore, the medical data drafts are available from the processing banks in relatively short order. The medical data drafts may be returned by the bank on a standard monthly basis or more frequently as the insurer requires and may establish with its bank. Once received by the insurer, the medical data available on the medical data draft may be analyzed for quality review purposes.

In FIG. 1, the medical data is entered by the medical care provider by marking the appropriate data categories. The data provided on the medical data draft may be scanned electronically, or read manually by the insurer. The actual patient medical data gathered may vary from insurer to insurer depending upon the type of information that is desired by that insurer for quality control and review purposes. The various categories indicated in FIG. 1 at areas 2, 3, 4, 5 and 6 are typical of the categories that have been used.

Figure 2:
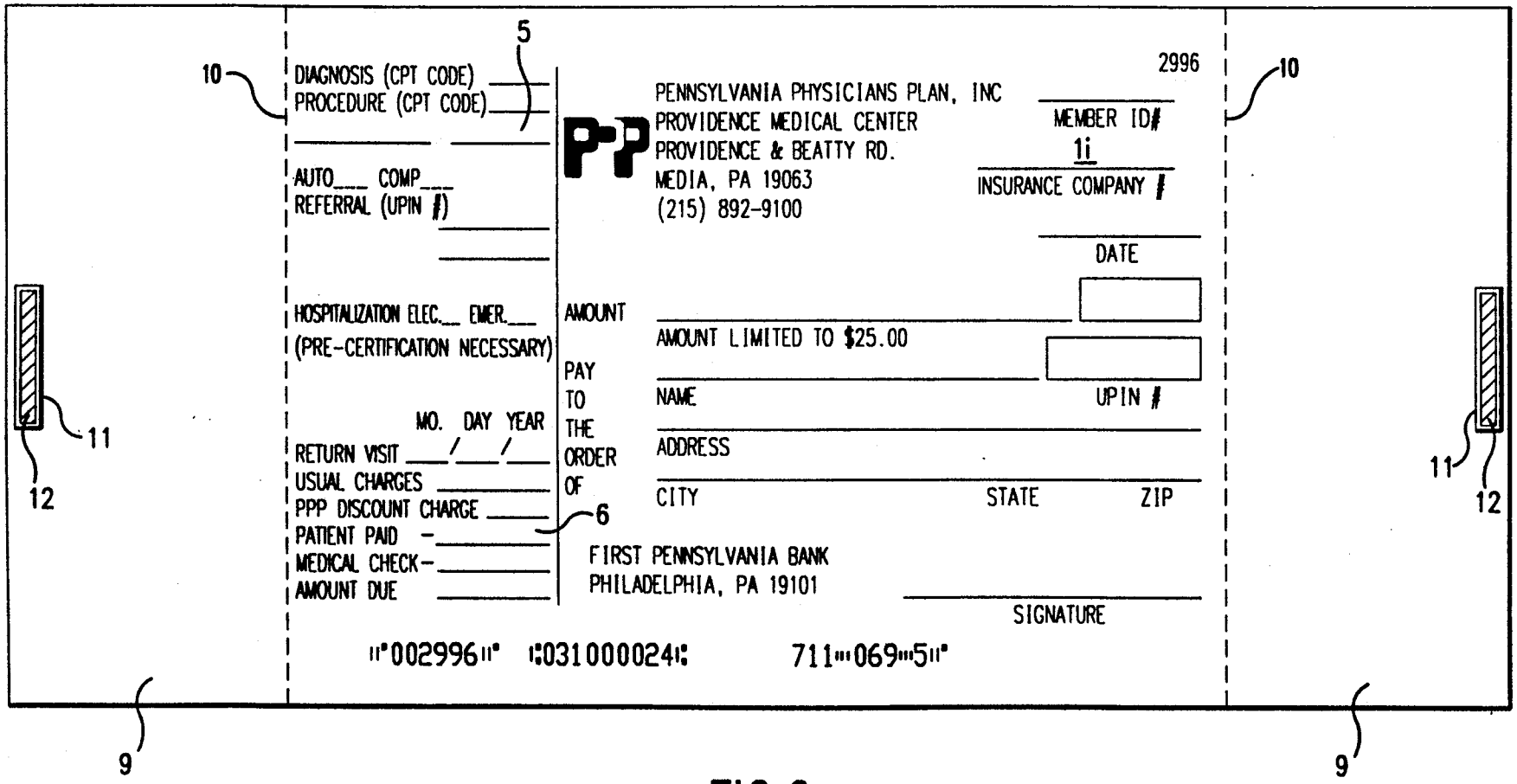
FIG. 2 shows the preferred embodiment of a medical data draft in which the medical data indicators are not printed on the medical data draft.
Figure 3:
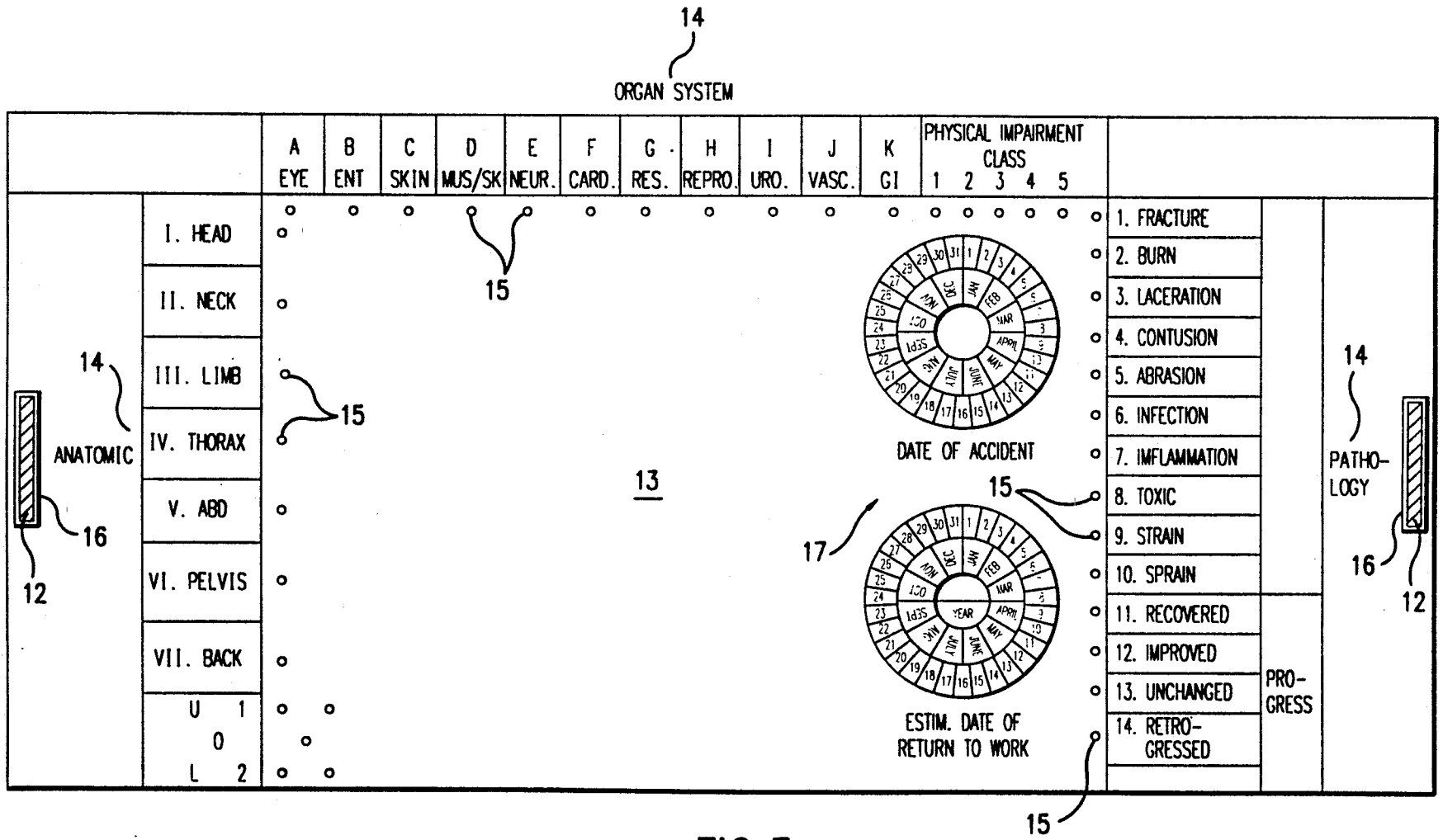
FIG. 3 shows a transparent overlay which has medical data indicators imprinted thereon for use with the medical data draft of FIG. 2.

FIGS. 2 and 3 show the preferred embodiment of the invention. FIG. 2 shows a medical data draft which does not have imprinted upon it the specific medical category indicators as does the medical data draft of FIG. 1. As in the medical data draft of FIG. 1, there is provided an area 5 in which can be entered specific diagnosis and procedure codes as well as additional information relating to hospitalization. In area 6, the cost and charge information for the patient visit may be recorded. However, the specific medical categories of treatment have been removed in order to maintain the confidentiality of the medical treatment rendered to the patient. The medical data draft has extension tabs 9 separated from the body of the draft by perforated scores 10. In tabs 9 are located holes 11 which permit the draft to be located over alignment posts 12. In use, the medical data draft is positioned over alignment posts 12, one at each end, so that its position on a support board is established. The negotiable instrument area of the medical data draft of FIG. 2 provides for the notation and entry of the same information as was used in the medical data draft of FIG. 1 with one addition. In the medical data draft of FIG. 2, an area 11 is provided in which to enter an insurer identification number.

FIG. 3 shows a typical overlay which is used with the medical data draft of FIG. 2. The overlay consists of a transparent sheet 13 upon which are imprinted the specific medical data categories 14. Sheet 13 has alignment holes 16 through it at each end which permit it to be placed over posts 12 to align the overlay with the underlying medical data draft. Through sheet 13 are small holes 15 which are placed next to and are associated with the medical data categories 14. Each hole 15 is large enough to permit a writing instrument to pass through it so that the writing instrument may make contact with the medical data draft underneath.

To use the preferred embodiment, a medical care provider places an appropriate overlay over the medical data draft and marks the medical data draft by placing the writing instrument through appropriate holes 15 in the overlay, the marks made by the writing instrument corresponding to the patient medical data which is recorded. After recording the data, the overlay is removed, and the check made out to the provider and signed by the provider. The medical care provider may then remove tabs 9 from the medical data draft by tearing along perforated scores 10. In this manner, the same type of medical information may be recorded on the medical data draft of FIG. 2 as may be recorded on the medical data draft of FIG. 1, but the confidentiality of the patient's medical data has been preserved. Thus, persons handling the medical data draft in the banking system can learn little more about the patient's visit to the medical care provider than they could learn from the patient's individual check submitted to the provider or from an insurance company check submitted to the provider.

An additional feature of the preferred embodiment, is that it is possible to use many different overlays coded for different types of patients and services. By using different overlays, it is possible to avoid the necessity of a medical care provider maintaining a supply of many different medical data drafts imprinted with different specific medical indicators. Thus, a medical care provider may choose an overlay appropriate to the nature of the services rendered or the nature of the claim. For instance, FIG. 3, shows an overlay which is used for a Workmens' Compensation medical visit. It will be noted that somewhat different medical data categories may be utilized for Workmens' Compensation claims than are used on the medical data draft of FIG. 2. For instance, additional data on the date of an accident and the estimated date of return to work of the accident victim/patient may be included as in area 17. It is not unusual for a medical care provider to have a mixture of Workmens' Compensation and non-Workmens' Compensation patients in any given day. Thus, such a provider would need only one form of the medical data draft on which to record different information for processing by the insurers for the different types of claims.

Medical data draft overlays specific to different types of medical practices may also be used. The patient treatment information needed for quality review of a surgeon or a neurologist may well differ from that required of a pediatrician. Thus, the method and apparatus of this invention accommodate the varying data recordation requirements. The overlays may be coded in different ways to enable the insurer, when reviewing the medical data draft, to distinguish which overlay has been used. For instance, the holes in the overlay through which the medical care provider marks the medical data draft ma be positioned in slightly different positions under each area of data recordation. The exact position of the marks on the medical data draft is then an indication of which overlay has been used. Alternatively, each overly may be coded with its own indicator hole so that, in addition to recording the medical data, the medical care provider uses the additional identifying hole to mark the medical data draft with an overlay indicator.

The use of many different overlays can be seen to add tremendous versatility and to expand greatly the range of data which may be obtained from medical care providers. By being able to particularize the data requested from a medical care provider, a better quality review of the medical care rendered may be achieved by the insurer. Once the data is in the hands of the insurer, the insurer may determine the particular quality review "flags" with which to review the data. The use of medical data drafts, reflective of each ambulatory visit, to establish a comprehensive data base to which appropriate quality review standards are applied represents a significant advance in the field of medical care review and yields significant savings in health care costs.

The simultaneous recordation and transmission of medical data along with payment to the medical care provider can be achieved by additional devices other than the medical data draft already disclosed. For instance, the patient's identification card can be coded with a magnetic strip identifying the patient, the insurance carrier, and the insurance carried by that patient. After swiping the patient's card through an electronic card scanner, such as are becoming increasingly common at many retail outlets, the medical care provider can enter the appropriate medical treatment data codes into the card data transmission scanner for transmission electronically through an electronic funds transfer (EFT) network. In an alternative embodiment, a microprocessor controlled printer can accept the medical data information and imprint a medical data draft at the medical care provider's facility with the financial, as well as the medical data information. Such a device can encode the medical data in any number of formats, including optically scannable characters or bar codes. The crucial point of this invention, which is achieved by all of the above devices, is the simultaneous recordation and transmission of the medical data at the time of payment to the medical care provider.

Once the medical data drafts are returned to the insurers, the data may be reviewed and compiled in any number of ways. For instance, for a small insurance group, a visual inspection and hand compilation of the data from the medical data drafts is easily and economically achieved. However, as the number of medical data drafts and patient visits increases across an insured population, the computerization of the data analysis becomes imperative.

There are two aspects to such computerization. The first aspect is that of reading the data from the medical data drafts into a computer data base. This may typically be achieved by the use of optical scanning devices. The second feature of computer analysis concerns the examination of the data for quality review and other purposes. The nature of the data gathered, of course, influences the questions which may be asked of the data base. The information which is gathered by the medical data drafts presented in FIG. 1 and FIG. 2 for the first time provide a broad picture of the scope of treatment at each patient visit. The data provides information on organ systems, as well as areas of the body which have been examined at the patient visit, and, therefore, provides clear indication of the underlying etiology of the patient's complaint. Once the data base has within it information for several patient visits for a given problem, the data can provide a clear indication for quality review purposes of the appropriateness of the treatment rendered to the patient.

Additionally, the data base can be examined for patterns of treatment by particular medical care providers for quality review purposes. Also, examination of the data base across geographical areas or different population parameters can yield information valuable to the insurer and the medical community as is discussed below. The correlation routines in the software programs which perform these evaluations have "flags" (indicia) determined by the medical professionals involved in the quality review assessment. These flags allow the computer to identify those situations where, according to the data base, proper medical quality review concerns are detected.

The flags may be as simple as a count of the number of office visits for a given condition. When such a count exceeds a quality review standard, it identifies the medical care provider and patient for individualized attention. Alternatively the "flag" may be very sophisticated, requiring the cross correlation of any number of parameters of data gathered in the medical data drafts, such as a prolonged series of visits to single or multiple medical care providers which do not yield a clear diagnosis of the patient's ailment. The sophistication of the quality review flags which may be used is determined by the type and extent of the data gathered, as well as by the experience of large insurers with their insured populations.

It should be quite clear that extensive amounts of data on each patient's visit may be gathered very quickly and accurately in this manner. Such data may then be analyzed by various analytical programs to determine the efficacy and appropriateness of patient care. Thus, data is gathered on every patient visit with a level of accuracy previously unattainable by quality review mechanisms.

The rapid availability of the medical data after it has been transmitted through the banking system, permits insurers to respond to unusual situations which are indicated by the flags in the quality review analysis system. Thus, attempts at fraud can be quickly detected and appropriate action taken. In addition, if indications of criminal acts, such as child abuse, are detected, appropriate action can be taken in a time frame to prevent further injury or abuse. Several additional advantages immediately arise as side benefits from the use of the method and apparatus of this invention, all of which make the administration of an insurance program more efficient and more comprehensive. For instance, the data may be used to analyze under-utilization as well as over-utilization of medical care. In the past, quality review systems have been principally concerned with detecting abuses of over-utilization of medical care, where unwarranted and expensive care is rendered without adequate medical necessity. By choosing appropriate criteria by which to analyze the data obtained, such over-utilization may be easily recognized by the method of this invention. In addition, however, this invention also permits the detection of under-utilization; i.e. situations where the objective measures of the patient's condition, as evidenced by the medical data recorded, indicate that the patient is not getting sufficient treatment for the medical problem. The feedback of such information through a quality control mechanism to the medical care providers involved, should improve the quality of care. Also, from a national prospective, the standard of care in a given community or area of the country for a given type of problem can be immediately obtained by analysis of the data. Such information, which is backed by a large statistically accurate data base, on appropriate standards of care has hitherto not been available. Knowledge of the standard of care being rendered on a community-by-community basis provides a unique opportunity for analyzing on a nation-wide basis trends in medical care. The cost control aspects of having a readily available data base with extensive data on every ambulatory visit cannot be overstated.

The problem of improper reporting of medical data to the insurer is also addressed by this invention. As mentioned earlier, once the Medicare Quality Review System has identified a doctor or hospital which is treating patients outside of its guidelines, Medicare may impose education requirements and other penalties if such physicians or hospitals do not meet the appropriate criteria in the future. Medicare, by statute, has the ultimate sanction of withdrawing a medical care provider's certification for payment by Medicare, a circumstance of great financial concern to the providers. Also, as noted earlier, private insurers currently have no such statutory authority to restrict payments to given medical care providers, and essentially, must rely upon patients to seek providers whom the insurers will reimburse in full. The method an apparatus of this invention provide a mechanism by which private insurers may implement quality review determinations. The mechanism for such enforcement is simply the removal of the medical care provider from the insurer's medical data draft payment system. Thus, if a provider issues checks to itself for services which the insurer deems inappropriate, the supply of replacement checks to the provider will be discontinued and the benefits to the provider of immediate payment for services will no longer be available. In addition, a private insurer can, by contract, with its insureds limit the insureds to treatment with medical care providers who participate in the medical data draft quality review system. Thus, the method and apparatus of this invention provide a mechanism by which private insurers can both monitor the quality of care delivered to ambulatory patients, as well as enforce quality review decisions based on the data generated by the medical care providers.

While the inventors have utilized the method and apparatus of this invention to implement a quality review procedure for their experimental insurance program, it is anticipated that the implementation of this invention on a broad scale by major insurers will require the establishment of quality control criteria by the cooperative endeavors of medical care providers, insureds, and insurers. This invention provides for the gathering and analysis of enormous amounts of data previously unobtainable and will, therefore, require the considered judgement of all parties to the medical care system in establishing quality control measures which sustain a high level of medical care while reducing unnecessary medical care which abuses the entire system.

There are several other ancillary features of the invention which merit special discussion. First, it should be clear that the type of medical data gathered can be particularized for any given insured population. Thus, different types of data may be gathered for Medicare recipients than would be gathered for a younger population. Clearly, the data elements necessary to achieve the quality control, which is the goal of the implementors of this invention, will vary from population group to population group.

Second, for the protection of the insurers, the medical data drafts, which the medical care providers are authorized to issue to themselves, have a set dollar limit per draft. The dollar limit may be set to substantially reimburse, at the time the draft is written, the medical care provider for most of the cost of the service just rendered. In this regard, the limit can be adjusted for different geographic areas and for different types of medical care providers to reflect differences in costs. Thus, if on the West Coast a typical office visit to a general practitioner would run approximately $25.00, the medical data draft would have a $25.00 limit. If the same service was provided for $35.00 in New York City, the value of the medical data draft could be increased appropriately. Similarly, for more costly medical care providers, such as neurosurgeons, the medical data draft could have a different limit than for less costly providers, such as pediatricians. The method and apparatus of this invention provides for such flexibility by both geography and the type of medical care provided.

Third, any medical care provider failing to enter all the proper medical data at the time that the medical data draft is filled out, would be quickly detected and encouraged to be more responsive and responsible. Continued failure by the medical care provider to meet its obligations at the time of issuing the drafts to itself would result in the issuer ceasing to allow the medical care provider to participate in the program. An insured of such an insurer could still seek the medical care services of that provider, but both the insured and the provider would have to contend with the paperwork and requirements of an alternative payment arrangement. Therefore, the economic incentive, which drives the successful implementation of this invention, is the immediate, prompt, and practically full payment to the medical car provider of the cost of services at the time the services are rendered.

Fourth, abuses of the medical system by the insureds are also immediately detectable. An insured's visit to multiple providers for the same service or for a service in which the same drug may be dispensed, would be rapidly and appropriately detected by the quality control indicators. Such information would allow the insurer to deal with such abuse in the manners provided for by the insurance contract. This type of data would also permit the insurer to identify medical care providers who seem not to be providing an adequate quality of service such that patients are forced to seek additional service elsewhere.

Fifth, the information generated by this invention permits the rapid determination of hitherto unrecognized demographic medical problems. Thus, the data base of all ambulatory visits for patients in a given geographic area might indicate a higher than expected incidence of a given disease in that area. Such a flag would be extraordinarily useful to medical authorities to detect and intervene in a serious situation of which they might not otherwise learn at all, or at best, only after an extended period of time. Whereas, one doctor in any given area might need to see several patients before recognizing a trend in a disease or medical situation, an insurer, who has access on a timely basis to information from all doctors in that region, would be in a position to immediately notice any common ailments occurring in that area, at least among its insureds. The method and apparatus of this invention permit the detection of problems which were previously undetectable or detectable only over a much longer time frame.

Sixth, in addition to achieving a reduction in the cost of medical care through a more extensively implemented quality review procedure for ambulatory care visits, the method and apparatus of this invention achieve as a side benefit a significant reduction in the cost of medical care, by significantly reducing, if not virtually eliminating in some cases, the largest single hidden cost of medical care. That cost is the cost to the medical care provider of financing and carrying the expense of the medical service rendered to the ambulatory care patient until such time as the provider is reimbursed for the service by the insurer. Typically, every provider must build into its rate structure an extra charge to cover both the costs of financing the service provided until payment is received and the cost of covering the risk that payment will never be received.

While it is true that the money which the insurer owes to the medical service provider earns interest for the insurer during the time between collection from the insured and disbursement to the medical care provider, the interest lost by the insurer may be more than offset by the ultimate reduction of the provider's service cost resulting from the elimination of not only the interest component but also the risk component of the service provider's charges. Thus, it is anticipated that, if the method and apparatus of this invention are employed on a wide scale by large insurers, significant savings will result merely from the timely and effective distribution of funds.

In addition to the above advantages and benefits which occur by virtue of the implementation of the method and apparatus of this invention, two additional consequences of the use of the invention should be mentioned. As noted above, the data base, which each insurer establishes with the information provided from the medical data drafts on each and every ambulatory visit, contains a comprehensive medical history of the treatment each patient has received. This record can obviously be made available to the patient for purposes outside of quality review by the insurer. For instance, if the patient should move to a different locale or wish to change doctors, the information can be provided as a fairly comprehensive medical record of prior treatment. Not only is this record available to the insurer to review for the insurer's quality review purposes, but would be available to the patient or the medical care provider as an outside verifiable record of the medical care provider's treatment should the patient ever require such an independent record. In fact, should the insurer's impartiality or competency in maintaining an accurate record of the medical data drafts ever be challenged, the redundant set of data created in the banking system provides an accessible and verifiable source for the same data.

The data bases which result from the use of the method and apparatus of this invention may also be of interest to parties other than the insurers, the insured, and the medical care providers. The value of the medical data to such organizations as the Center for Disease Control and state health agencies cannot be overstated. In addition, several government agencies at both the federal and state level, including the IRS, may have valid use for the financial data which would also be available from such data bases. The benefits of employing the method and apparatus of this invention are not restricted to those mentioned above, but encompass other uses which rely upon the accurate and timely transmission of medical data.

What is claimed is:

1. A medical data draft to be used by a health care provider to authorize payment thereto for a particular procedure performed on a patient, said payment being drawn from a bank account of an insurance provider, said patient being a member of a health plan provided by said insurance provider, said medical data draft comprising:

a first portion preprinted with spaces for insurance membership information of said patient;

a second portion preprinted with information pertaining to a bank draft, including the identifies of the payor and of the bank, and spaces for the date, the amount of the payment, and the name and other identifying indicia of the payee, wherein said payor is said insurance provider and said payee is said health care provider; and a third portion distinct from said first and second portions and preprinted with information pertaining to the medical status of said patient and the procedure performed by said health care provider;

wherein said health care provider is authorized for a payment from said insurance provider based upon information input by said health care provider in said third portion, and whereby completed medical data drafts can be used by said insurance provider to perform a quality review of health care services rendered by said health care provider.

2. The draft of claim 1 wherein said third portion includes locations preprinted with designations of selected anatomic body portions.

3. The draft of claim 1 wherein said third portion includes locations preprinted with designations of selected pathologies.

4. The draft of claim 1 wherein said third portion includes locations preprinted with designations of selected organs and internal body systems.

5. The draft of claim 1 wherein said third portion is preprinted with blank spaces identified as being adapted to be filled in with medical diagnoses and other variable data pertaining to examination, treatment and related cost and charge information.

6. A block of drafts according to claim 1.

7. The block of claim 6, in which the drafts are sequentially numbered.

8. The draft of claim 1 wherein said second portion includes first, second and third fields for recording, respectively, applicable patient anatomy, organ system and pathology data.

9. The draft of claim 1 wherein said third portion includes first, second and third locations preprinted, respectively, with designations of selected anatomic body portions, organ systems, and pathologies.

* * * * *